US008246297B2

(12) United States Patent
Jain et al.

(10) Patent No.: US 8,246,297 B2
(45) Date of Patent: Aug. 21, 2012

(54) SHROUD SEGMENT COOLING CONFIGURATION

(75) Inventors: Kapila Jain, Kirkland (CA); Marc Tardif, Candiac (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 893 days.

(21) Appl. No.: 12/176,529

(22) Filed: Jul. 21, 2008

(65) Prior Publication Data

US 2010/0014985 A1 Jan. 21, 2010

(51) Int. Cl.
*F04D 31/00* (2006.01)

(52) U.S. Cl. ..... 415/116; 415/173.1; 415/173.2; 415/175; 415/176; 415/178

(58) Field of Classification Search ..... 415/116, 415/173.1, 173.2, 175, 176, 178
See application file for complete search history.

(56) References Cited

U.S. PATENT DOCUMENTS

| | | | | |
|---|---|---|---|---|
| 2,220,420 | A | 11/1940 | Meyer | |
| 3,628,880 | A | 12/1971 | Smuland et al. | |
| 4,317,646 | A | 3/1982 | Steel et al. | |
| 4,672,727 | A | 6/1987 | Field | |
| 5,392,515 | A | 2/1995 | Auxier et al. | |
| 5,399,065 | A | 3/1995 | Kudo et al. | |
| 5,584,651 | A | 12/1996 | Pietraszkiewicz et al. | |
| 6,146,091 | A | 11/2000 | Watanabe et al. | |
| 6,155,778 | A | 12/2000 | Lee et al. | |
| 6,354,795 | B1 | 3/2002 | White et al. | |
| 6,508,620 | B2 | 1/2003 | Sreekanth et al. | |
| 6,899,518 | B2 * | 5/2005 | Lucas et al. | 415/116 |
| 2006/0127212 | A1 | 6/2006 | Durocher et al. | |

OTHER PUBLICATIONS

Canadian Office Action dated May 11, 2011 issued by the Canadian Intellectual Property Office with respect to Applicant's corresponding Canadian application No. 2,662,042.

* cited by examiner

*Primary Examiner* — Ajay K Arora
(74) *Attorney, Agent, or Firm* — Norton Rose Canada LLP

(57) ABSTRACT

An cooling arrangement for a turbine shroud provides an air stream directed from a passage extending through a radial wall to impinge on a surface in an area of a back side of the turbine shroud, the surface defining a plane which improves the attack angle of the air stream to the surface.

18 Claims, 3 Drawing Sheets

32c
63
62
38
64
60
58
A
40
52
56
46
48
30
34
32a
50
58
60
34
64
48
36

38
46
3
34
44
56
58
64
52
48
3
50
42
36
32a
40

SHROUD SEGMENT COOLING CONFIGURATION

TECHNICAL FIELD

The technique relates generally to gas turbine engines, and more particularly, to an improved turbine shroud cooling configuration of gas turbine engines.

BACKGROUND OF THE ART

Turbine shrouds, which may be configured as shroud segments, have forward and aft legs extending radially outwardly therefrom for mounting the shrouds to structural components of the engine. The leading edge of the shroud extends axially upstream from the leading edge of the turbine blades and results in a relatively large overhang as measured between the shroud leading edge and the forward leg from which it is supported. It is difficult to apply effective cooling to the outer surfaces of the shroud.

Accordingly, there is a need to provide an improved shroud cooling configuration.

SUMMARY OF THE DESCRIPTION

In one aspect, the technique provides a turbine static shroud which comprises a turbine shroud platform extending from a leading edge to a trailing edge, the platform having a hot gas side and a back side, the hot gas side configured to encircle at least a portion of a turbine blade set, the platform having first and second legs extending outwardly from the back side, a plurality of exit passages extending through at least one of said legs, each passage having a central axis intersecting the platform at an intersection point and the passage configured to direct an air stream through said leg to impinge on a surface of the back side, the intersection points of the passages disposed on the surface, the surface extending out of a plane defined by the back side.

In another aspect, the technique provides a turbine shroud segment of a gas turbine engine which comprises a platform extending between opposite leading and trailing edges with respect to a hot gas flow through the engine, the platform defined between two opposite side edges extending substantially axially with respect to a rotational axis of the engine, the platform having a hot gas side and a back side opposite to the hot gas side; at least one leg extending radially from the back side of the platform, the leg spaced apart from an adjacent one of the leading and trailing edges to define an overhang portion of the back side between the leg and the adjacent one of the leading and trailing edges; and at least one air passage extending through the at least one leg for directing an air stream through the at least one leg to impinge the platform back side at a surface defined on the overhang portion, the surface being one of a recess defined into and a projection extending out of the overhang portion of back side of the platform.

In a further aspect, the technique provides for a shroud segment for a gas turbine engine which comprises a platform having an arcuate flow path surface configured to surround a row of rotating turbine blades, the platform also having an arcuate outer surface opposed to the flow path surface and extending generally axially between a platform leading edge and a platform trailing edge, the platform having forward and aft legs extending radially outwardly from the outer surface, the legs having opposed sidewalls which define an open shroud plenum; the forward leg disposed on the platform axially spaced apart from the leading edge to define an a leading edge overhang portion of the platform between the forward leg and the leading edge, the overhang portion including a forward portion of said opposed outer surface of the platform, the outer surface forward portion defining a circumferentially extending impingement surface defined by the outer surface forward portion and distinct from the outer surface forward portion; and at least one cooling hole extending from said shroud plenum through the forward leg, the hole positioned so that a central axis of the hole intersects the surface such that in use a cooling airflow directed through the hole impinges the impingement surface.

Further details of these and other, aspects of the technique will be apparent from the detailed description and drawings included below.

DESCRIPTION OF THE DRAWINGS

Reference is now made to the accompanying figures depicting aspects of the described technique, in which.

DETAILED DESCRIPTION

Figure 1:
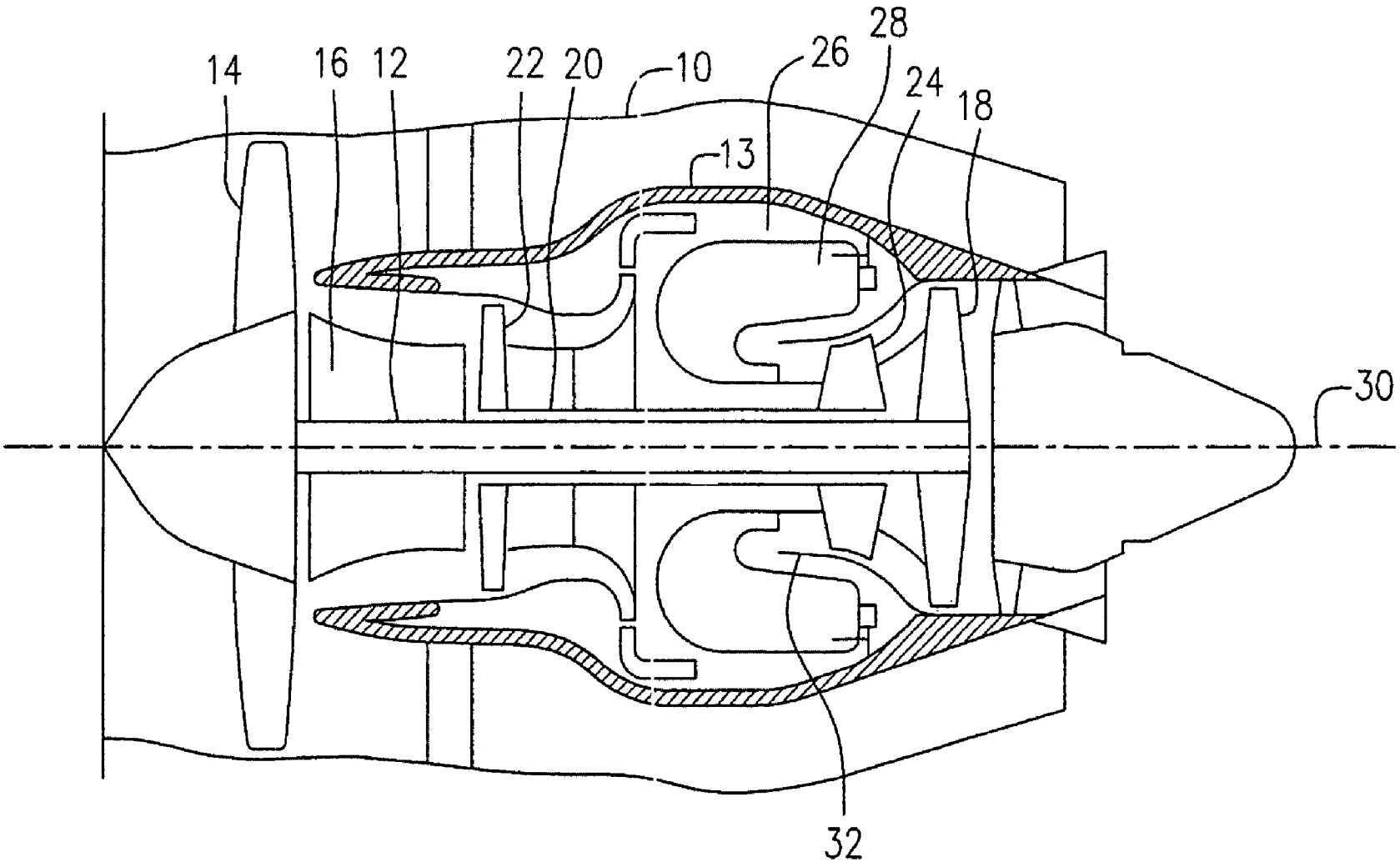
FIG. 1 is schematic cross-sectional view of a bypass gas turbine engine as an exemplary application of the described technique.

Referring to FIG. 1, a bypass gas turbine engine presented as an example of the application of the described technique, includes a housing or nacelle 10, a core casing 13, a low pressure spool assembly seen generally at 12 which includes a fan assembly 14, a low pressure compressor assembly 16 and a low pressure turbine assembly 18, and a high pressure spool assembly seen generally at 20 which includes a high pressure compressor assembly 22 and a high pressure turbine assembly 24. The core casing 13 surrounds the low and high pressure spool assemblies 12 and 20 in order to define a main fluid path (not indicated) therethrough. In the main fluid path there is provided a combustor 28 to constitute a gas generator section 26. The rotational axis of the engine is indicated by numeral 30.

Referring to FIGS. 1-4, the high pressure turbine assembly 24 includes a turbine shroud 32 surrounding the high pressure turbine rotor (not indicated). The turbine shroud 32 may be an integral shroud ring or may be assembled as a plurality of turbine shroud segments 32*a*, each forming a circumferential section of the turbine shroud 32. For convenience of description, the turbine shroud segment 32*a* is taken as an embodiment of the described technique, and is described with technical details hereinafter.

The turbine shroud segment 32*a* includes a platform 34 which forms a circumferential section of a shroud ring of the turbine shroud 32 when the segments 32*a* are assembled together. The platform 34 extends between opposite leading and trailing edges 36 and 38 with respect to a hot gas flow 40 which passes under the turbine shroud 32, i.e. through the turbine blades, to rotate the high pressure turbine rotor. The platform 34 also extends between two opposite substantially axial side edges 42, 44 with respect to the rotational axis 30 of the engine. The platform 34 thus defines a hot gas side 46 having a radially inner surface (not indicated) which may be substantially axial and is exposed directly to the hot gas flow 40, and a back side 48 which is opposite to the hot gas side 46 and defines a radially outer surface (substantially axial) of the platform 34.

The turbine shroud segment 32a further includes a forward leg 50 and a rear leg 52 extending radially outwardly from the back side 48 of the platform 34. The forward and rear legs 50, 52 are configured to be mounted to a stationary structure of the engine, to thereby support the turbine shroud segment 32*a* and thus the turbine shroud 32 in position. The structural details of the forward and rear legs may vary in different engines. In this embodiment, the forward leg 50 is located near but spaced apart from the leading end 36 of the platform 34, thereby defining an overhang section 54 as measured between the leading end 36 and the forward leg 50 from which it is supported.

The turbine shroud 32*a*, and in particular the platform 34, is cooled by providing bleed air from, for example the high pressure compressor assembly 22, into a plenum 56 defined by the forward and rear legs 50, 52 and the back side 48 of the platform 34. One or more air passages 58 extend through the forward leg 50 which forms a radial wall of the plenum 56, in order to direct the cooling air within the plenum 56 toward an area of the back side of the overhang section 54 of the platform 34.

The one or more passages 58 may be formed by one or more straight holes in an inclining orientation with respect to the rotational axis 30 of the engine, from the plenum 56 toward the overhang section 54, for directing the cooling air from the plenum 56 to impinge on the surface on the back side 48 of the overhang section 54.

Figure 4:
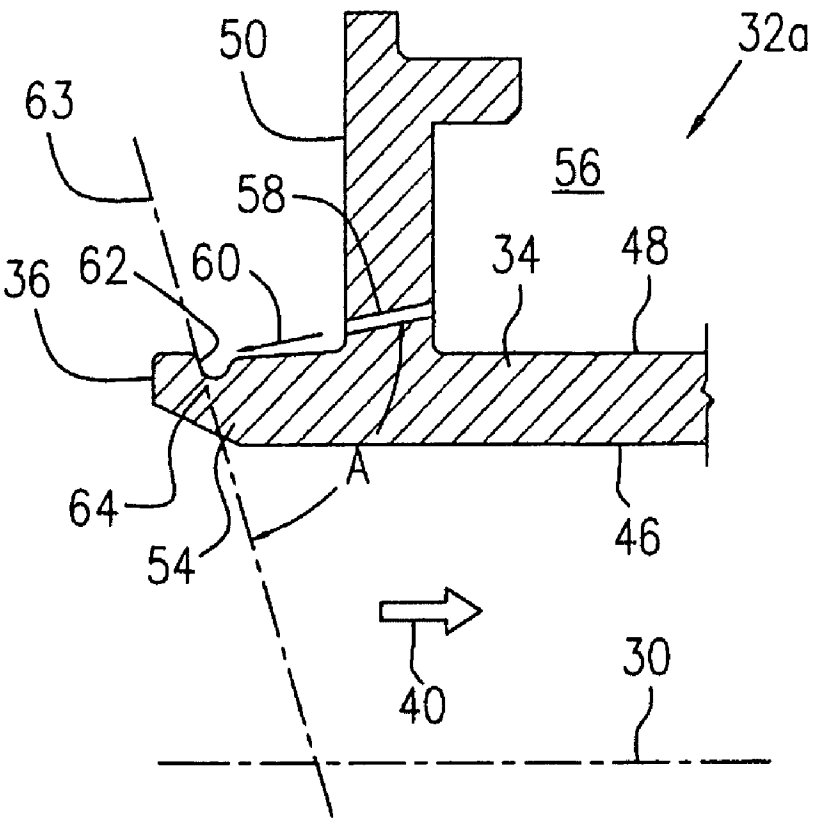
FIG. 4 is a partial cross-sectional view of the turbine shroud taken along line 3-3 in FIG. 2.

The overhang region 54 at an intersection point with a central axis (indicated by arrow 60) of the passage 58, which receives the impingement cooling air stream flowing along arrow 60, may be configured to define a surface 62 extending out of the plane defined by the back side 48. Surface 62 determines a plane 63 intersecting the rotational axis 30 of the engine, as shown in FIG. 4. In this embodiment, this surface 62 is provided by a side of a recess such as circumferential groove 64 defined on the back side 48 of the overhang section 54 of the platform 34 near the leading end 36 of the platform, on which the cooling air stream 60 impinges. The circumferential groove 64 may extend from one of the axial side edges 42, 44 to the other. If more than one air passage 58 is defined through the forward leg 50 of the shroud segment 32*a*, the respective air passages 58 may be configured similarly but may be circumferentially spaced apart as shown in FIG. 4.

Without the circumferential groove 64, the air stream 60 would attack a surface on the back side 48 of the overhang section 54 at a sharply acute or shallow angle which may adversely affect the impingement cooling result on the overhang section 54 of the platform 34. The circumferential groove 64 provides the surface 62 on one side thereof facing the air passage 58, defining the surface 62 thereon to be impinged upon by the air stream 60 at a more desirable angle, indicated by "A", for example between 60 to 90 degrees. When the angle "A" is substantially 90 degrees, the impingement cooling effect of the air stream 60 will achieve a maximum performance. However the degree of the angle "A" is determined by various factors such as the cross-sectional geometry of the circumferential groove 64, the orientation of the passage 58, etc. which should be determined taking into consideration the whole structural configuration of the turbine shroud segments 32*a* or the turbine shroud 32.

Figure 5:
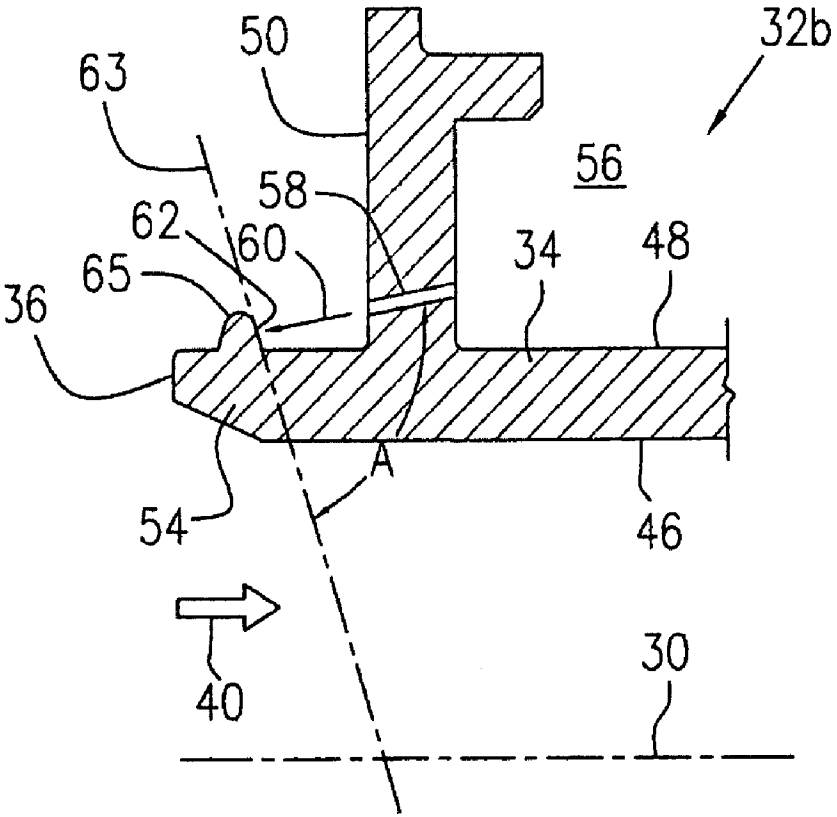
FIG. 5 is partial cross-sectional view of a turbine shroud segment according to another embodiment of the described technique.

According to another embodiment as shown in FIG. 5, a turbine shroud segment 32*b* similar to the turbine shroud segment 32*a* is described, which forms a circumferential section of the turbine shroud in FIG. 1. The components and features of the turbine shroud segment 32*b* which are similar to those of turbine shroud segment 32*a* of FIG. 4, are indicated by similar numerals and will not be repeated. A projection, such as a circumferential ridge 65 projecting from the back side 48 of the overhang section 54 of the platform 34 of the turbine shroud segment 32*b*. Therefore, the circumferential ridge 65 provides surface 62 facing the passage 58, to be impinged upon by the air stream 60. This surface, similar to the surface 62 of the circumferential groove 64 defines the plane 63 which intersects the turbine rotating axis 30, at an angle "A" with respect to the air stream 60 (or the air passage 58). The angle "A" may be between 60 and 90 degrees, and may be determined by the cross-sectional geometry of the circumferential ridge 65 and other factors of the turbine shroud segment 32*b*.

Figures 2, 3, 6:
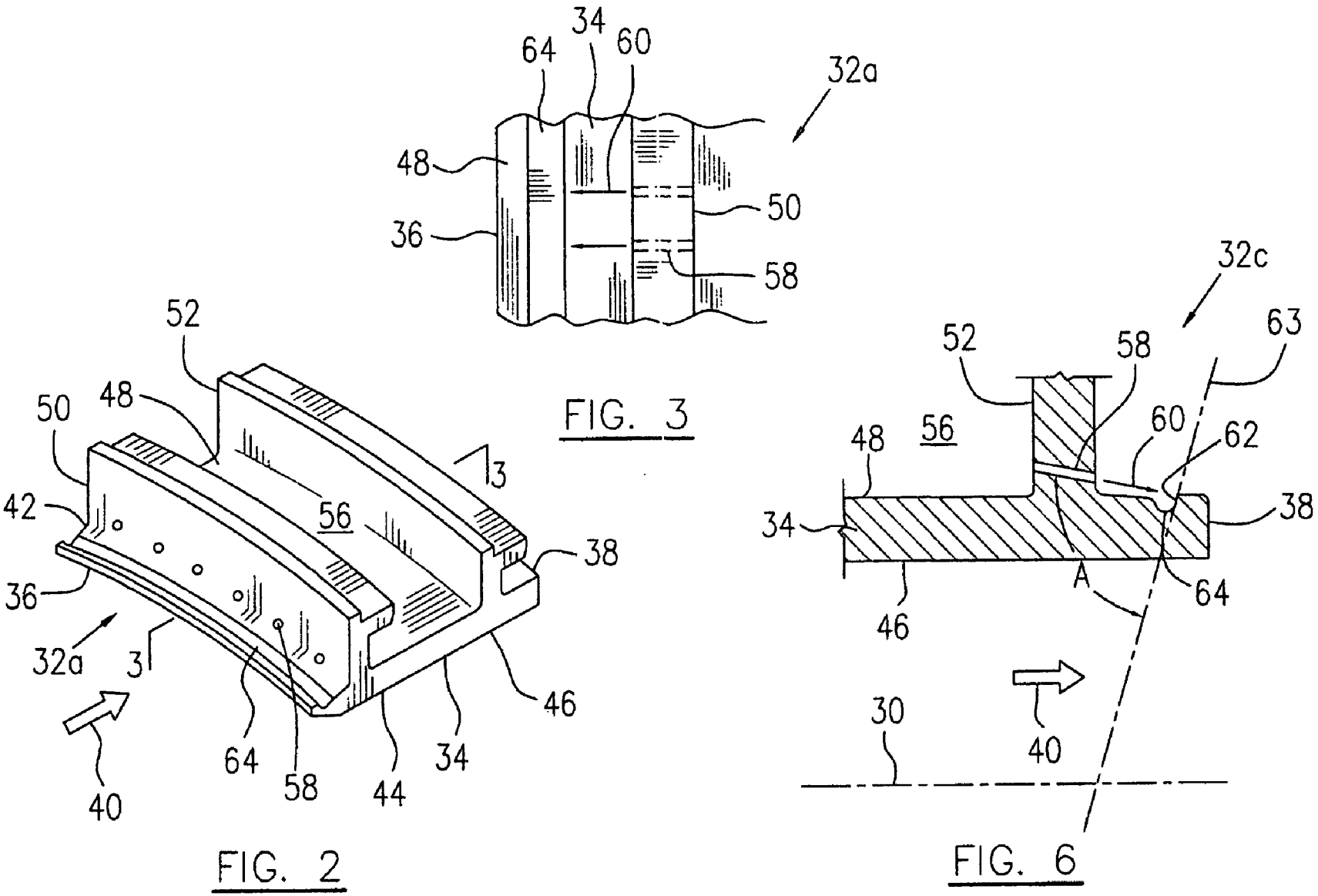
FIG. 2 is a perspective view of a turbine shroud segment according to one embodiment of the described technique.
FIG. 3 is partial top plane view of the turbine shroud segment of FIG. 2.
FIG. 6 is a partial cross-sectional view of the turbine shroud segment according to a further embodiment of the described technique.

The above description is meant to be exemplary only, and one skilled in the art will recognize that changes may be made to the embodiments described without departure from the scope of the technique disclosed. For example, a bypass gas turbine engine is used as, an example of the application of this technique but this technique is applicable to any other type of gas turbine engine. A high pressure turbine stage is illustrated and described as the immediate environment of the shroud impingement cooling arrangement. However, the shroud impingement cooling arrangement of this technique may be applicable to other types of turbine assemblies. The impingement cooling surface on the back, side of the turbine shroud segment need not be planar and may be configured may be provided in any suitable manner other than a circumferential groove or a circumferential ridge, such as individual recesses or projections aligning with the air passages for directing the cooling air streams. Such shroud impingement cooling arrangements may also be used for cooling an area near the trailing edge of a turbine shroud segment which is located downstream of the rear leg of the turbine shroud segment, as shown in FIG. 6. The components and features of the turbine shroud segment 32*c* in FIG. 6 are indicated by similar numerals and will not be repeated. This kind of shroud impingement cooling arrangement may also be applicable to an integral turbine shroud or other shroud segments having different mounting or support configurations. Still other modifications which fall within the scope o f the described technique will be apparent to those skilled in the art, in light of a review of this disclosure, and such modifications are intended to fall within the appended claims.

The invention claimed is:

1. A turbine static shroud of a gas turbine engine disposed around a rotational axis of the engine and comprising a turbine shroud platform extending from a leading edge to a trailing edge, the platform having a hot gas side and a back side, the hot gas side configured to encircle at least a portion of blade tips of a turbine blade set, the platform having first and second legs extending radially outwardly from the back side with respect to the rotational axis of the engine, a plurality of exit passages disposed radially outwardly and entirely spaced from the platform with respect to the rotational axis of the engine, the exit passages extending through at least one of said legs and terminating at respective opposed leg surfaces, each passage having a central axis intersecting the platform at an intersection point and the passage configured to direct an air stream through said leg to impinge on a surface of the back side, the intersection point of the central axis of each of the passages disposed on the surface, the surface extending out of a plane defined by the back side.

2. The turbine static shroud as defined in claim 1 wherein the passages central axes are at an angle of between 60 and 90 degrees with respect to a plane defined by the surface.

3. The turbine static shroud as defined in claim 1 wherein said surface is disposed on the back side of the turbine shroud between said leg and an adjacent one of the leading and trailing edges of the turbine shroud.

4. The turbine static shroud as defined in claim 1 wherein the surface is provided on a side of a circumferentially-extending groove defined in the back side of the turbine shroud.

5. The turbine static shroud as defined in claim 1 wherein the surface is provided on a side of a circumferentially-extending ridge projecting outwardly from the back side of the turbine shroud.

6. The turbine static shroud as defined in claim 4 wherein the central axis of each of the exit passages is substantially perpendicular to the surface defined on the side of the circumferential groove.

7. The turbine static shroud as defined in claim 5 wherein the central axis of each of the exit passages is substantially perpendicular to the surface defined on the side of the circumferential ridge.

8. A turbine shroud of a gas turbine engine, having a plurality of circumferential shroud segments disposed around a rotational axis of the engine, each of the shroud segments comprising:

a platform extending between opposite leading and trailing edges with respect to a hot gas flow through the engine, the platform defined between two opposite side edges extending substantially axially with respect to the rotational axis of the engine, the platform having a hot gas side and a back side opposite to the hot gas side;

at least one leg extending radially outwardly from the back side of the platform with respect to the rotational axis of the engine, the leg spaced apart from an adjacent one of the leading and trailing edges to define an overhang portion of the back side between the leg and the adjacent one of the leading and trailing edges; and at least one air passage disposed radially outwardly and entirely spaced from the platform with respect to the rotational axis of the engine, the at least one air passage extending through the at least one leg and terminating at respective opposed leg surfaces for directing an air stream through the at least one leg to impinge the platform back side at a surface defined on the overhang portion, the surface being one of a recess defined into and a projection extending out of the overhang portion of back side of the platform.

9. The turbine shroud segment as defined in claim 8 wherein the surface is located between a forward leg of the shroud and the leading edge of the platform and the air passage extends through the forward leg.

10. The turbine shroud segment as defined in claim 8 wherein the surface is located between an aft leg of the shroud and the trailing edge of the platform and the air passage extends through the aft leg.

11. The turbine shroud segment as defined in claim 8 wherein the one of a recess and a projection is a circumferential groove defined on the back side of the platform.

12. The turbine shroud segment as defined in claim 11 wherein the surface is provided on a far side of said groove relative to the leg.

13. The turbine shroud segment as defined in claim 11 wherein the circumferential groove extends substantially from one of the side edges of the platform to the other.

14. The turbine shroud segment as defined in claim 11 wherein the air passage extends in a direction substantially perpendicular to one side of the circumferential groove.

15. The turbine shroud segment as defined in claim 8 wherein the one of a recess and a projection is a circumferential ridge projecting from the back side of the platform.

16. The turbine shroud segment as defined in claim 15 wherein the air passage extends in a direction substantially perpendicular to a near side of the circumferential ridge.

17. A shroud segment forming a circumferential section of a turbine shroud disposed around a rotational axis of a gas turbine engine, the shroud segment comprising:

a platform having an arcuate flow path surface configured to surround a row of rotating turbine blades, the platform also having an arcuate outer surface opposed to the flow path surface and extending generally axially in a direction of a hot gas flow passing by the flow path surface, from a leading edge of a platform forward end to a trailing edge at a platform aft end, the platform having forward and aft legs extending radially outwardly from the outer surface with respect to the rotational axis of the engine, the legs having opposed sidewalls which define an open shroud plenum; the forward leg disposed on the platform axially spaced apart from the leading edge to define a leading edge overhang portion of the platform between the forward leg and the leading edge, the overhang portion including a portion of said opposed outer surface of the platform, the overhang portion defining a circumferentially extending impingement surface joining said outer surface portion and distinct from said outer surface portion; and at least one cooling hole in fluid communication with said shroud plenum, extending through the forward leg and terminating at opposed leg surfaces, the hole positioned radially outwardly and entirely spaced from the platform with respect to the rotational axis of the engine, so that a central axis of the hole intersects a surface of the overhang portion of the platform such that in use a cooling airflow directed through the hole impinges the impingement surface.

18. The shroud segment of claim 17 wherein the impingement surface comprises at least one of a circumferentially-extending groove spanning the shroud segment and a circumferentially-extending ridge spanning the shroud segment.

* * * * *